US005155088A

United States Patent [19]

Evans et al.

[11] Patent Number: 5,155,088

[45] Date of Patent: Oct. 13, 1992

[54] MAGENTA THIOPHENEAZOANILINE DYE-DONOR ELEMENT FOR THERMAL DYE TRANSFER

[75] Inventors: Steven Evans, Rochester, N.Y.; William H. Moore; Max A. Weaver, both of Kingsport, Tenn.

[73] Assignee: Eastman Kodak Company, Rochester, N.Y.

[21] Appl. No.: 693,503

[22] Filed: Apr. 30, 1991

[51] Int. Cl.[5] ..... B41M 5/035; B41M 5/26

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS

| | | | |
|---|---|---|---|
| 4,614,521 | 9/1986 | Niwa et al. | 8/471 |
| 4,764,178 | 8/1988 | Gregory et al. | 8/471 |
| 4,999,026 | 3/1991 | Evans et al. | 8/471 |

FOREIGN PATENT DOCUMENTS

| | | | |
|---|---|---|---|
| 60-239291 | 11/1985 | Japan | 503/227 |

*Primary Examiner*—B. Hamilton Hess
*Attorney, Agent, or Firm*—Harold E. Cole

[57] ABSTRACT

A dye-donor element for thermal dye transfer comprises a support having thereon a dye dispersed in a polymeric binder, the dye having the formula:

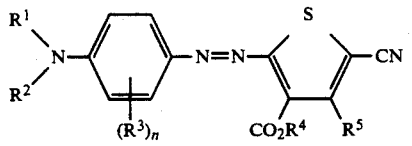

wherein $R^1$ and $R^4$ each independently represents a substituted or unsubstituted alkyl group having from 1 to 6 carbon atoms, a substituted or unsubstituted cycloalkyl group having from 5 to 7 carbon atoms, a substituted or unsubstituted aryl group having from 6 to about 10 carbon atoms, a substituted or unsubstituted hetaryl group having from 5 to about 10 carbon atoms or an allyl group;

$R^2$ represents $R^1$ or hydrogen;

or $R^1$ and $R^2$ may be taken together to represent the atoms necessary to complete a 5- to 7-membered ring;

or one or both of $R^1$ and $R^2$ can be combined with one or two of $R^3$ to form one or two 5- to 7-membered rings;

$R^3$ and $R^5$ each independently represents $R^1$, halogen, an alkoxy group, an acylamido group, a cyano group, an alkylthio group or an arylthio group;

or one or two of $R^3$ can be combined with $R^1$ and/or $R^2$ to form one or two 5- to 7-membered rings;

or two $R^3$'s can be taken together to represent the atoms necessary to complete a 5- to 7-membered fused ring; and n can be from 0 to 3.

20 Claims, No Drawings

MAGENTA THIOPHENEAZOANILINE DYE-DONOR ELEMENT FOR THERMAL DYE TRANSFER

This invention relates to dye-donor elements used in thermal dye transfer which have good hue and dye stability.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of certain dyes in dye-donor elements for thermal dye transfer printing. Many of the dyes proposed for use do not have adequate stability to light. Others do not have good hue. It would be desirable to provide dyes which have good light stability and have improved hues.

Thiopheneazoaniline dyes have been disclosed in the thermal transfer art. For example JP-60/239291 and U.S. Pat. No. 4,614,521 disclose the use of thiopheneazoanilines. However, the examples therein describe only dyes containing 3,5-dinitro- or 3-cyano-5-nitro-thiophene residues. Those dyes are not magenta, since their absorption maximum is significantly greater than 600 nm.

U.S. Pat. No. 4,764,178 broadly disclose heterocyclazoaniline dyes for thermal transfer imaging. As will be seen later in the EXAMPLE herein, we have compared the dyes of our invention against a number of thiopheneazoaniline dyes disclosed in this patent. In each case, the presence of 3-alkoxycarbonyl-5 cyano substituents result in better hue (absorption maximum nearer to 550 nm) and better light stability.

In U.S. Pat. No. 4,999,026 thiopheneazoanilines are disclosed in which the thiophene is substituted in the 3-position with cyano, the 5-position with formyl, cyano or nitro, and the 4-position with chloro, alkoxy or alkylthio. As discussed above, the dyes used in this invention are superior to typical dyes encompassed by this reference.

As will be shown below, the dyes of this invention are also superior to 3,5-bis(alkoxycarbonyl) (see C-7 in Table 3) and 3-acyl-5-alkoxycarbonyl (see C-3 in Table 2) derivatives.

Thus substantial improvements in light stability, yet maintaining good hue and good transfer densities are achieved in accordance with this invention which comprises a dye-donor element for thermal dye transfer comprising a support having thereon a magenta dye dispersed in a polymeric binder, the dye having the formula:

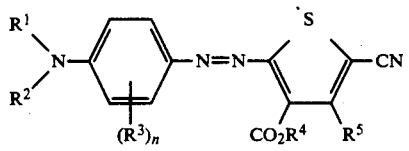

wherein $R^1$ and $R^4$ each independently represents an alkyl group having from 1 to about 6 carbon atoms, such as methyl, ethyl, propyl, t-butyl, 2-hexyl; a cycloalkyl group having from 5 to 7 carbon atoms, such as cyclopentyl, cyclohexyl, and cyclopethyl substituents; an aryl group having 6 to about 10 carbon atoms, such as phenyl or naphthyl; a hetaryl group having from 5 to about 10 carbon atoms, such as pyridyl, pyrazolyl, imidazolyl, furyl, pyrolidino, thienyl; or an allyl group; and substituted alkyl, cycloalkyl, aryl, hetaryl and allyl groups, in which the substituent can be, for example, aryl, halogen, cyano, hydroxy, acyloxy, alkoxycarbonyl, alkoxy, aryloxy or acylamido; such as,

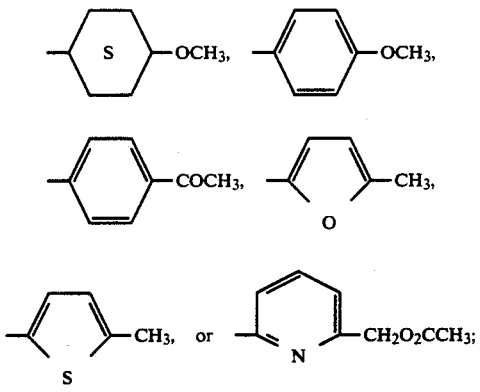

$R^2$ represents $R^1$ or hydrogen;

or $R^1$ and $R^2$ may be taken together to represent the atoms necessary to complete a 5- to 7-membered ring;

or one or both of $R^1$ and $R^2$ can be combined with one or two of $R^3$ to form one or two 5- to 7-membered rings;

$R^3$ and $R^5$ each independently represents $R^1$; halogen; an alkoxy group having from 1 to 6 carbon atoms, such as methoxy or ethoxy; an acylamido group having from 1 to 6 carbon atoms, such as $NHCOH_3$, $NHCOC_2H_5$ or $NHCOC_4H_9$; a cyano group; an alkylthio group having from 1 to 6 carbon atoms, such as $SCH_3$, $SC_2H_5$, $SC_5H_{11}$ or $SCH_2C_6H_5$; an arylthio group having from 6 to 10 carbon atoms, such as $SC_6H_5$;

or one or two of $R^3$'s can be combined with $R^1$ and/or $R^2$ to form one or two 5- to 7-membered rings;

or two $R^3$'s can be taken together to represent the atoms necessary to complete a 5- to 7-membered fused ring; and n can be from 0 to 3.

Representative specific examples of 3-carboalkoxy-5-cyanothiopheneazoaniline magenta dyes used in the invention include the following:

TABLE I

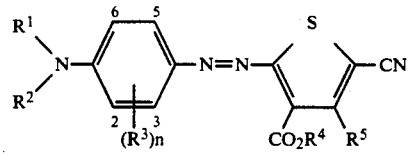

| Compound | $R^1$ | $R^2$ | $R^3$ | $R^4$ | $R^5$ |
|---|---|---|---|---|---|
| E-1 | n-$C_3H_7$ | n-$C_3H_7$ | 3-$NHCOCH_3$ | $CH_3$ | $CH_3$ |
| E-2 | $C_2H_5$ | $C_2H_5$ | 3-$CH_3$ | $CH_3$ | $CH_3$ |
| E-3 | $C_2H_5$ | H | 2,3-(CH=CH—CH=CH—) | $C_2H_5$ | $CH_3$ |
| E-4 | $C_2H_5$ | H | 2-$OCH_3$, 5-$CH_3$ | $CH_3$ | $CH_3$ |
| E-5 | s-$C_6H_{13}$ | H | 2-$OCH_3$, 5-$CH_3$ | $CH_3$ | $CH_3$ |
| E-6 | s-$C_6H_{13}$ | H | 2-$OCH_3$, 5-($NHCOCH_3$) | $CH_3$ | $CH_3$ |
| E-7 | $CH_3OCH_2CH_2$ | $C_2H_5$ | 2-$SCH_2CH_3$ | $C_6H_5$ | $NHCOCH_3$ |
| E-8 | $CH_3CO_2C_2H_4$ | $CH_3CO_2C_2H_4$ | 3-$CH_3$ | n-$C_4H_9$ | H |
| E-9 | $C_6H_5$ | H | 2,5-$(OCH_3)_2$ | c-$C_5H_{11}$ | CN |
| E-10 | $C_2H_5$ | $C_2H_5$ | 3-Cl | $C_2H_4OCH_3$ | $C_2H_5$ |
| E-11 | $C_2H_5$ | $C_6H_5CH_2$ | 2,5-$(CH_3)_2$ | $CH_2C_6H_5$ | $OC_4H_9$ |
| E-12 | c-$C_6H_{13}$ | H | 2-$OC_2H_5$ 5-($NHSO_2CH_3$) | i-$C_3H_7$ | $C_6H_5$ |
| E-13 | $CH_2$=CH—$CH_2$ | $CH_2$=CH—$CH_2$ | 3-$CH_3$ | $CH_3$ | $C_2H_5$ |
| E-14 | 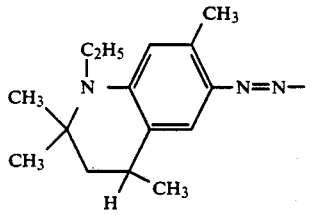 | | | $C_2H_5$ | $CH_3$ |

The magenta thiopheneazoaniline dyes used herein can be prepared as disclosed in M. A. Weaver and L. Shuttleworth, Dyes and Pigments, 3, pp 81–121 (1992); the disclosure of which is herein incorporated by reference.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye in the dye-donor element of the invention is dispersed in a polymeric binder such as a cellulose derivatives, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene-co-acrylonitrile), a poly(sulfone) or a poly(phenylene oxide). The binder may be used at a coverage of from about 0.1 to about 5 $g/m^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polymides such as polymide-amides and polyetherimides. The support generally has a thickness of from about 2 to about 30 μm. It may also be coated with a subbing layer, if desired, such as those materials described in U.S. Pat. Nos. 4,695,288 and 4,737,486.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711, 4,717,712, 4,737,485, 4,738,950, and 4,829,050. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 $g/m^2$. If a polymeric binder is employed, the lubricating material is present in the range of 0.001 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polymide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,698,651, 4,695,287, 4,701,439, 4,757,046, 4,743,582, 4,769,360, and 4,753,922; the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and a magenta dye as described above, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-A040MCSOO1), a TDK Thermal Head F415 HH7-1089 or a Rohm Thermal Head KE 2008-F3.

A thermal dye transfer assemblage of the invention comprises:

(a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE

A magenta dye-donor element was prepared by coating the following layers in the order recited on a 6 μm poly(ethylene terephthalate) support:

1) Subbing layer of DuPont Tyzor TBT® titanium tetra-n-butoxide (0.16 g/m$^2$) coated from a n-butyl alcohol and n-propyl acetate solvent mixture, and
2) Dye layer containing the dye identified below and illustrated above (0.36 mmoles/m$^2$), in a cellulose acetate-propionate (2.5% acetyl, 48% propionyl) binder (weight equal to 2.6X that of the dye) coated from a toluene, and methanol solvent mixture.

A slipping layer was coated on the back side of the element similar to that disclosed in U.S. Pat. No. 4,829,050.

Control dye-donor elements were prepared as described above with each of the following dyes at 0.36 mmoles dye/m$^2$.

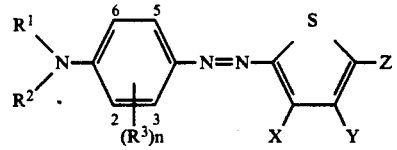

| Control Dye | $R^1$, $R^2$ | $R^3$ | X | Y | Z |
|---|---|---|---|---|---|
| C-1 | n-$C_3H_7$ | 3-($NHCOCH_3$) | CN | $CH_3$ | CN |
| C-2 | n-$C_3H_7$ | 3-($NHCOCH_3$) | CN | $CH_3$ | $CO_2C_2H_5$ |
| C-3 | $C_2H_5$ | 3-($NHCOCH_3$) | $COCH_3$ | $CH_3$ | $CO_2C_2H_5$ |
| C-4 | $C_2H_5$ | 3-($NHCOCH_3$) | $NO_2$ | H | $NO_2$ |
| C-5 | $C_2H_5$ | 3-($CH_3$) | CN | $CH_3$ | CN |
| C-6 | $C_2H_5$ | 3-($CH_3$) | CN | $CH_3$ | $CO_2CH_3$ |
| C-7 | $C_2H_5$ | 3-($CH_3$) | $CO_2C_2H_5$ | $CH_3$ | $CO_2C_2H_5$ |
| C-8 | H, $C_2H_5$ | 2,3-(—CH=CH—CH=CH—) | CN | $CH_3$ | $CO_2C_2H_5$ |
| C-9 | H, $C_2H_5$ | 2-($OCH_3$), 5-$CH_3$ | CN | $CH_3$ | CN |
| C-10 | H, s-$C_6H_{13}$ | 2-($OCH_3$), 5-$CH_3$ | CN | $CH_3$ | $CO_2CH_3$ |
| C-11 | H, $C_2H_5$ | 2-($OCH_3$), 5-($NHCOCH_3$) | CN | $CH_3$ | CN |
| C-12 | H, s-$C_6H_{13}$ | 2-($OCH_3$) 5-($NHCOCH_3$) | $NO_2$ | H | $NO_2$ |

-continued

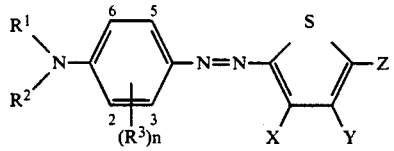

| Control Dye | $R^1$, $R^2$ | $R^3$ | X | Y | Z |
|---|---|---|---|---|---|
| C-13 | | | CN | $CH_3$ | $CO_2CH_3$ |
| C-14 | | | $CO_2C_2H_5$ | $CH_3$ | CN |

A dye-receiving element was prepared by coating a solution of Makrolon 5705 ® (Bayer AG Corporation) polycarbonate resin (2.9 g/m$^2$), Fluorad FC431 ® Surfactant (3M Corporation) and polycaprolactone (0.81 g/m$^2$) in methylene chloride on a pigmented polyethylene-overcoated paper stock.

The dye side of the dye-donor element strip approximately 10 cm × 13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 36 Newtons against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed at 29 μsec/pulse at 128 μsec intervals during the 33 μsec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot.

The dye-receiving element was separated from the dye-donor element. The Status A Green reflection maximum density of each stepped image was read.

The image was then subjected to fading for 7 days, 50 klux, 5400° K., 32° C., approximately 25% RH and the density was reread. The percent density loss from D-max (the highest density step) was calculated. The λ-max (absorption maxima) of each dye in an acetone solution was also determined. The following results were obtained:

| Compound | λmax (nm) | Status A Green Maximum Density | Percent Dye Fade |
|---|---|---|---|
| E-1 | 557 | 1.8 | 29 |
| C-1 (Control) | 577 | 1.5 | 37 |
| C-2 (Control) | 567 | 1.5 | 49 |

-continued

| Compound | λmax (nm) | Status A Green Maximum Density | Percent Dye Fade |
|---|---|---|---|
| C-3 (Control) | 547 | 2.0 | 76 |
| C-4 (Control) | 635* | 1.9* | 78* |
| E-2 | 551 | 2.1 | 10 |
| C-5 (control) | 571 | 1.4 | 23 |
| C-6 (Control) | 551 | 1.8 | 19 |
| C-7 (Control) | 541 | 1.9 | 52 |
| E-3 | 577 | 1.3 | 38 |
| C-8 (Control) | 595 | 0.8 | 48 |
| E-4 | 547 | 1.6 | 15 |
| E-5 | 549 | 2.0 | 10 |
| C-9 (Control) | 575 | 1.5 | 22 |
| C-10 (Control) | 560 | 1.9 | 17 |
| E-6 | 575 | 1.4 | 27 |
| C-11 (Control) | 598 | 1.0 | 36 |
| C-12 (Control) | 658* | 1.8* | 77* |
| E-14 | 564 | 1.8 | 15 |
| C-13 (Control) | 586 | 1.2 | 31 |
| C-14 (Control) | 569 | 1.8 | 28 |

*These control dyes are too bathochromic (bluish in hue) to be considered magenta dyes, thus maximum density and dye fade were obtained with Status A Red filter.

The above data clearly illustrates the uniqueness in using magenta 3-alkoxycarbonyl-5-cyano substituted-thiopheneazoaniline dyes in thermal transfer imaging. The dyes of invention, wherein the thiophene residue was substituted in the 3-position with an alkoxycarbonyl group and in the 5-position with a cyano group have improved light stability compared to closely-related dyes wherein the defined substituents were not so positioned.

The magenta dyes of the invention are also in many instances superior in hue (less absorption on the long wavelength position of the spectrum), and give higher transferred dye density.

The invention has been described in detail with particular reference to preferred embodiments thereof, but it will be understood that variations and modifications can be effected within the spirit and scope of the invention.

We claim:

1. A dye donor element for thermal dye transfer comprising a support having thereon a magenta dye dispersed in a polymeric binder, said dye having the formula:

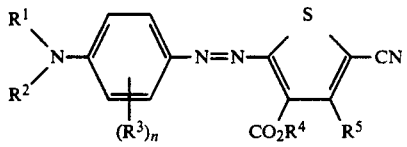

wherein $R^1$ and $R^4$ each independently represents a substituted or unsubstituted alkyl group having from 1 to 6 carbon atoms, a substituted or unsubstituted cycloalkyl group having from 5 to 7 carbon atoms, a substituted or unsubstituted aryl group having from 6 to about 10 carbon atoms, a substituted or unsubstituted hetaryl group having from 5 to about 10 carbon atoms or an allyl group;

$R^2$ represents $R^1$ or hydrogen;

or $R^1$ and $R^2$ may be taken together to represent the atoms necessary to complete a 5- to 7-membered ring;

or one or both of $R^1$ and $R^2$ can be combined with one or two of $R^3$ to form one or two 5- to 7-membered rings;

$R^3$ and $R^5$ each independently represents $R^1$, halogen, an alkoxy group, an acylamido group, a cyano group, an alkylthio group or an arylthio group;

or one or two of $R^3$ can be combined with $R^1$ and/or $R^2$ to form one or two 5- to 7-membered rings;

or two $R^3$'s can be taken together to represent the atoms necessary to complete a 5- to 7-membered fused ring; and n can be from 0 to 3.

2. The element of claim 1 wherein $R^1$ and $R^2$ are H, $C_2H_5$, $C_3H_7$ or $C_6H_{13}$.

3. The element of claim 1 wherein $R^3$ is $CH_3$ or $C_6H_6$.

4. The element of claim 1 wherein $R^4$ is $CH_3$ or $C_2H_5$.

5. The element of claim 1 wherein $R^5$ is CH3.

6. The element of claim 1 wherein $R^1$ and $R^2$ are H, $C_2H_5$, $C_3H_7$ or $C_6H_{13}$, $R^3$ is $CH_3$ or $C_6H_6$, $R^4$ is $CH_3$ or $C_2H_5$ and $R^5$ is $CH_3$.

7. The element of claim 1 wherein $R^1$ is $C_3H_7$, $R^2$ is $C_H3_7$, n is 0, $R^4$ is $CH_3$ and $R^5$ is $CH_3$.

8. The element of claim 1 wherein $R^1$ is $C_2H_5$, $R^2$ is $C_2H_5$, $R^3$ is $CH_3$, $R^4$ is $CH_3$ and $R^5$ is $CH_3$.

9. The element of claim 1 wherein $R^1$ is $C_2H_5$, $R^2$ is H, $R^3$ is $CH_3$, $R^4$ is $CH_3$ and $R^5$ is $CH_3$.

10. The element of claim 1 wherein $R^1$ is $C_6H_{13}$, $R^2$ is H, $R^3$ is $CH_3$, $R^4$ is $CH_3$ and $R^5$ is $CH_3$.

11. The element of claim 1 wherein $R^1$ is $C_6H_{13}$, $R^2$ is H, n is 0, $R^4$ is $CH_3$ and $R^5$ is $CH_3$.

12. The element of claim 1 wherein said support comprises poly(ethylene terephthalate) and the side of the support opposite the side having thereon said dye layer is coated with a slipping layer comprising a lubricating material.

13. The element of claim 1 wherein said dye layer comprises repeating areas of yellow, cyan and said magenta dye.

14. In a process of forming a dye transfer image comprising imagewise-heating a dye donor element comprising a support having thereon a dye layer comprising a dye dispersed in a polymeric binder and transferring a dye image to a dye-receiving element to form said dye transfer image, the improvement wherein said dye has the formula:

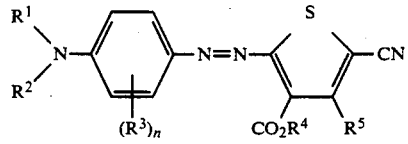

wherein $R^1$ and $R^4$ each independently represents a substituted or unsubstituted alkyl group having from 1 to 6 carbon atoms, a substituted or unsubstituted cycloalkyl group having from 5 to 7 carbon atoms, a substituted or unsubstituted aryl group having from 6 to about 10 carbon atoms, a substituted or unsubstituted hetaryl group having from 5 to about 10 carbon atoms or an allyl group;

$R^2$ represents $R^1$ or hydrogen;

or $R^1$ and $R^2$ may be taken together to represent the atoms necessary to complete a 5- to 7-membered ring;

or one or both of $R^1$ and $R^2$ can be combined with one or two of $R^3$ to form one or two 5- to 7-membered rings;

$R^3$ and $R^5$ each independently represents $R^1$, halogen, an alkoxy group, an acylamido group, a cyano group, an alkylthio group or an arylthio group;

or one or two of $R^3$ can be combined with $R^1$ and/or $R^2$ to form one or two 5- to 7-membered rings;

or two $R^3$'s can be taken together to represent the atoms necessary to complete a 5- to 7-membered fused ring; and n can be from 0 to 3.

15. The process of claim 14 wherein said support is poly(ethylene terephthalate) which is coated with sequential repeating areas of yellow, cyan and said magenta dye, and said process steps are sequentially performed for each color to obtain a three-color dye transfer image.

16. In a thermal dye transfer assemblage comprising:

(a) a dye donor element comprising a support having thereon a dye layer comprising a dye dispersed in a polymeric binder, and (b) a dye-receiving element comprising a support having thereon a dye image-receiving layer, said dye-receiving element being in superposed relationship with said dye-donor element so that said dye layer is in contact with said dye image-receiving layer, the improvement wherein said dye has the formula:

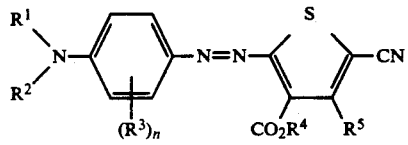

wherein $R^1$ and $R^4$ each independently represents a substituted or unsubstituted alkyl group having from 1 to 6 carbon atoms, a substituted or unsubstituted cycloalkyl group having from 5 to 7 carbon atoms, a substituted or unsubstituted aryl group having from 6 to about 10 carbon atoms, a substituted or unsubstituted hetaryl group having from 5 to about 10 carbon atoms or an allyl group;

$R^2$ represents $R^1$ or hydrogen;

or $R^1$ and $R^2$ may be taken together to represent the atoms necessary to complete a 5- to 7-membered ring;

or one or both of $R^1$ and $R^2$ can be combined with one or two of $R^3$ to form one or two 5- to 7-membered rings;

$R^3$ and $R^5$ each independently represents $R^1$, halogen, an alkoxy group, an acylamido group, a cyano group, an alkylthio group or an arylthio group;

or one or two of $R^3$ can be combined with $R^1$ and/or $R^2$ to form one or two 5- to 7-membered rings;

or two $R^3$'s can be taken together to represent the atoms necessary to complete a 5- to 7-membered fused ring; and n can be from 0 to 3.

17. The assemblage of claim 16 wherein $R^1$ and $R^2$ are H, $C_2H_5$, $C_3H_7$ or $C_6H_{13}$.

18. The assemblage of claim 16 wherein $R^3$ is $CH_3$ or $C_6H_6$.

19. The assemblage of claim 16 wherein $R^4$ is $CH_3$ or $C_2H_5$ and $R^5$ is $CH_3$.

20. The assemblage of claim 16 wherein $R^1$ and $R^2$ are H, $C_2H_5$, $C_3H_7$ or $C_6H_{13}$, $R^3$ is $CH_3$ or $C_6H_6$, $R^4$ is $CH_3$ or $C_2H_5$ and $R^5$ is $CH_3$.

* * * * *